US009698573B2

(12) United States Patent
Walker, Jr.

(10) Patent No.: US 9,698,573 B2
(45) Date of Patent: Jul. 4, 2017

(54) EXTRUDED INSULATOR FOR SPARK PLUG AND METHOD OF MAKING THE SAME

(71) Applicant: FEDERAL-MOGUL IGNITION COMPANY, Southfield, MI (US)

(72) Inventor: William J. Walker, Jr., Ann Arbor, MI (US)

(73) Assignee: FEDERAL-MOGUL IGNITION COMPANY, Southfield, MI (US)

( * ) Notice: Subject to any disclaimer, the term of this patent is extended or adjusted under 35 U.S.C. 154(b) by 397 days.

(21) Appl. No.: 14/076,840

(22) Filed: Nov. 11, 2013

(65) Prior Publication Data

US 2014/0138122 A1 May 22, 2014

Related U.S. Application Data

(60) Provisional application No. 61/729,060, filed on Nov. 21, 2012.

(51) Int. Cl.
*H01T 13/34* (2006.01)
*H01T 13/38* (2006.01)
*H01T 21/02* (2006.01)

(52) U.S. Cl.
CPC ..... *H01T 13/34* (2013.01); *H01T 13/38* (2013.01); *H01T 21/02* (2013.01)

(58) Field of Classification Search
CPC ..... H01T 13/34; H01T 21/02; H01T 13/38
USPC ..... 264/635, 632, 614, 618, 645
See application file for complete search history.

(56) References Cited

U.S. PATENT DOCUMENTS 2,305,877 A * 12/1942 Klingler ..... B28B 1/24 264/328.16
2,382,805 A 8/1945 Mosthaf
3,337,668 A * 8/1967 Karl Mohle ..... B28B 3/02 235/1 B
4,185,061 A * 1/1980 Hinton ..... B28B 3/02 264/332
4,464,192 A * 8/1984 Layden ..... C03B 19/025 264/125
4,551,293 A * 11/1985 Diehl, Jr. ..... B29C 55/24 264/150

(Continued)

FOREIGN PATENT DOCUMENTS

DE 69804788 T2 11/2002
DE 102007027319 A1 12/2008

(Continued)

OTHER PUBLICATIONS

German Search Report dated Sep. 30, 2015, 5 pages.

*Primary Examiner* — Nahida Sultana
(74) *Attorney, Agent, or Firm* — Reising Ethington, P.C.

(57) ABSTRACT

A method for making an extruded insulator for a spark plug in a manner that minimizes pores, relics and/or other defects in the insulator microstructure so that the overall dielectric strength or performance of the insulator is improved. The method may be used to manufacture an extruded insulator that avoids many of the drawbacks associated with such defects, but also has a stepped internal bore for receiving a center electrode. In one embodiment, the method uses a multi-phase extrusion process to extrude a ceramic paste around an elongated arbor and form an extruded section, and then removes the arbor from the extruded section to reveal a stepped internal bore.

13 Claims, 2 Drawing Sheets

(56) References Cited

U.S. PATENT DOCUMENTS 4,810,458 A * 3/1989 Oshima ..... B28B 13/04 264/177.11
5,227,105 A * 7/1993 Eucker ..... B28B 3/20 264/102
5,993,985 A * 11/1999 Borglum ..... B28B 3/2627 264/433
6,137,211 A * 10/2000 Sugimoto ..... H01T 21/02 313/141
6,470,726 B1 * 10/2002 Murata ..... B21C 25/08 264/167
6,583,537 B1 * 6/2003 Honda ..... H01T 13/41 313/135
7,169,723 B2 * 1/2007 Walker, Jr. ..... C04B 35/117 313/130
7,980,908 B2 7/2011 Niessner et al.
8,053,966 B2 11/2011 Walker, Jr.
9,054,502 B1 * 6/2015 Walker, Jr. ..... H01T 13/20
9,073,250 B2 * 7/2015 Eisenstock ..... B28B 3/224
2004/0197557 A1 * 10/2004 Eshraghi ..... D01D 5/24 428/375
2005/0096567 A1 * 5/2005 Reynolds ..... A61M 25/09 600/585
2005/0110382 A1 * 5/2005 Walker, Jr. ..... C04B 35/117 313/143
2007/0123412 A1 * 5/2007 Walker, Jr. ..... C04B 35/117 501/127
2007/0227606 A1 * 10/2007 Sakazaki ..... F16L 11/111 138/121
2009/0256461 A1 * 10/2009 Walker, Jr. ..... H01T 21/02 313/137
2012/0068390 A1 3/2012 Walker, Jr.

FOREIGN PATENT DOCUMENTS

SU 1791124 A1 1/1993
WO WO9855424 A1 12/1998

* cited by examiner

EXTRUDED INSULATOR FOR SPARK PLUG AND METHOD OF MAKING THE SAME

REFERENCE TO RELATED APPLICATIONS

This application claims the benefit of U.S. Provisional Ser. No. 61/729,060 filed on Nov. 21, 2012, the entire contents of which are incorporated herein.

TECHNICAL FIELD

This disclosure generally relates to insulators for spark plugs and, more particularly, to extruded insulators and methods of making the same.

BACKGROUND

Spark plug insulators are typically made from hard dielectric materials, such as ceramic materials made from alumina, and are designed to provide mechanical support for a center electrode while also providing electrical isolation between the center electrode and a metallic shell. The dielectric strength or dielectric breakdown strength of a spark plug insulator generally refers to the applied electrical field at which the insulator breaks down and experiences a rapid reduction in electrical resistance. Because spark plug insulators are expected to electrically isolate the center electrode from the metallic shell, the dielectric strength of the insulator is an important characteristic of the component and can affect the overall performance of the spark plug.

The dielectric strength of an insulator can be affected by pores, relics and/or other defects in the ceramic microstructure of the component. Dry pressing is a conventional method for manufacturing spark plug insulators, however, this method is somewhat prone to the formation of pores. Other manufacturing methods, such as extruding, have shown some signs of reducing the number of pores in the ceramic microstructure, but these methods have traditionally been unable to produce an insulator structure that includes certain features like a stepped internal bore within the insulator. A stepped internal bore is needed to properly seat and secure the center electrode within the insulator.

SUMMARY

According to one embodiment, there is provided a method of making an extruded insulator for a spark plug. The method comprises the steps of: inserting a ceramic paste into an extrusion die; inserting an arbor into the ceramic paste in the extrusion die; extruding the ceramic paste around the arbor so as to form an extruded section; severing the extruded section from the rest of the ceramic paste in the extrusion die; and removing the arbor from the extruded section so as to form an extruded insulator blank having a stepped internal bore.

According to another embodiment, there is provided an extruded insulator for use in a spark plug, comprising: a first distal end; a second distal end; and a stepped internal bore axially extending between the first and second distal ends and including at least one internal step portion, wherein the extruded insulator is comprised of an extruded and fired ceramic paste and has a microstructure with few pores and relics.

DRAWINGS

Preferred exemplary embodiments will hereinafter be described in conjunction with the appended drawings, wherein like designations denote like elements, and wherein.

DESCRIPTION

The method described herein may be used to make an extruded insulator for a spark plug in a manner that minimizes pores, relics and/or other defects in the insulator microstructure so that the overall dielectric strength or performance of the insulator is improved. As previously mentioned, some conventional methods for making spark plug insulators utilize a process of dry pressing ceramic powders, however, dry pressed insulators can be prone to certain defects in the insulator microstructure, such as relics. Relics are structures that are present in the microstructure due to incomplete joining of the granular spray-dried feed powder conventionally used for dry pressing. These defects can reduce or negatively affect the dielectric performance of the insulator and are generally undesirable. Extruded insulators have fewer pores and relics, but because of the nature of the extrusion process, they usually cannot be formed with a stepped internal bore which is needed to accommodate or seat certain center electrodes. The present method may be used to manufacture an extruded insulator that avoids many of the drawbacks associated with pores, relics and/or other defects in the insulator microstructure, but also has a stepped internal bore for receiving a center electrode. Although the following description is provided in the context of an automotive spark plug, it should be appreciated that the extruded insulator and method described herein may be used with any type of spark plug or ignition device, including glow plugs, industrial plugs, aviation igniters and/or any other device that is used to ignite an air/fuel mixture in an engine.

Figure 1:
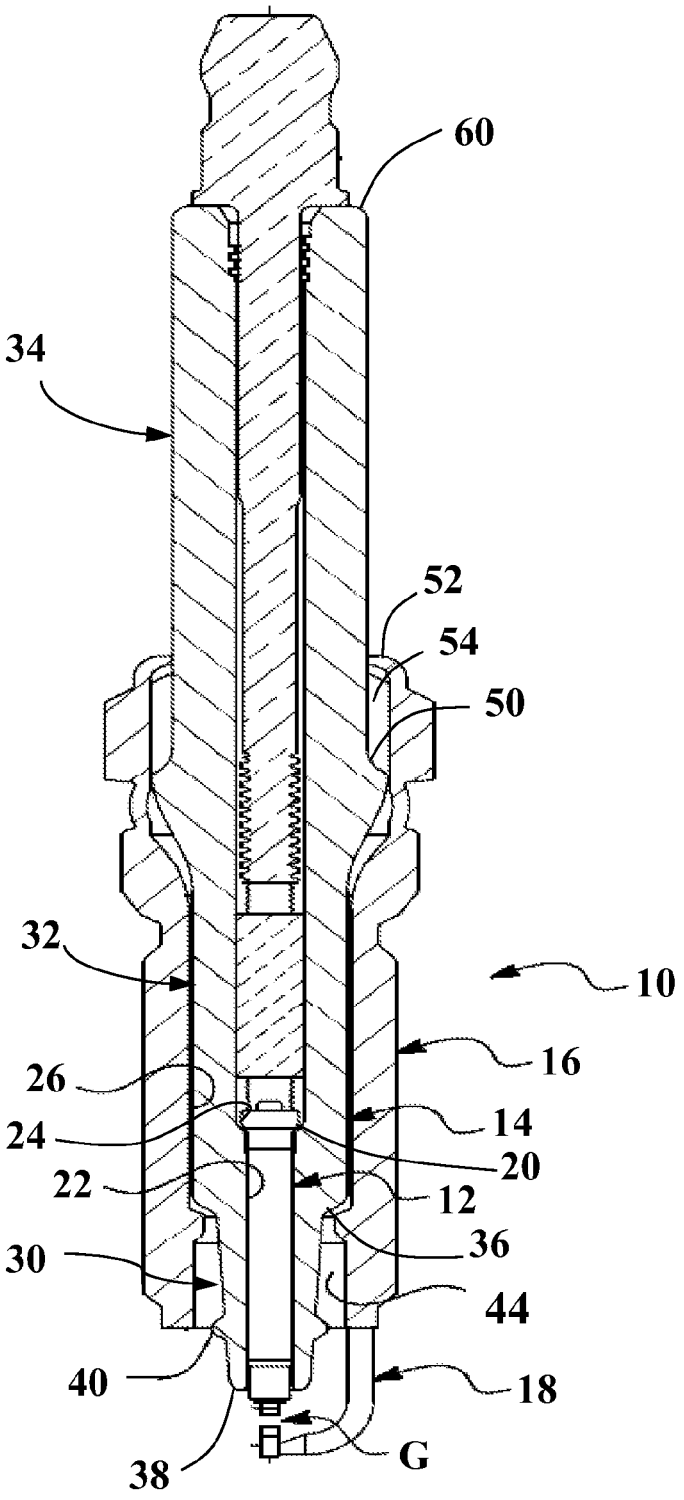
FIG. 1 is a cross-sectional view of an exemplary spark plug.

An exemplary spark plug is shown in FIG. 1, where the spark plug has an extruded insulator with a stepped internal bore. The spark plug 10 includes a center electrode 12, an extruded insulator 14, a metallic shell 16, and a ground electrode 18. The center electrode 12, which can be a single unitary component or can include a number of separate components, is at least partially disposed or located within an internal bore 22 that extends along the axial length of the extruded insulator 14. As illustrated, the internal bore 22 includes one or more internal step portions 24 that circumferentially extend around the inside of the bore and are designed to receive complementary external step portions or shoulders 20 of the center electrode 12. In the exemplary embodiment of FIG. 1, the internal bore 22 only includes a single internal step or shoulder portion 24; however, it is possible for the internal bore to include additional internal step portions at different axial positions along the length of the bore. The extruded insulator 14 is at least partially disposed within an internal bore 26 of the metallic shell 16, and the internal bore 26 extends along the length of the metallic shell and is generally coaxial with the internal bore 22. In the particular embodiment shown, a tip end of the extruded insulator 14 extends from and protrudes beyond the end of the metallic shell internal bore 26, and a tip end of the center electrode 12 extends from and protrudes beyond the insulator internal bore 22. The tip end of the center electrode 12 forms a spark gap G with a corresponding portion of the ground electrode 18; this may include embodiments with or without precious metal firing elements on the center electrode and/or the ground electrode. In the FIG. 1 embodiment, both the center and ground electrodes 12, 18 have precious metal firing elements attached thereto, but this is optional and is not required.

Turning now to extruded insulator 14, the insulator is an elongated and generally cylindrical component that is made from an electrically insulating material and is designed to isolate the center electrode 12 from the metallic shell 16 so that high-voltage ignition pulses in the center electrode are directed to the spark gap G. The extruded insulator 14 includes a nose portion 30, an intermediate portion 32, and a terminal portion 34, however, other configurations or embodiments are certainly possible.

The nose portion 30 extends in the axial or longitudinal direction between an external step 36 on the outer surface of the insulator and a distal end 38 located at a tip of the insulator. In the exemplary embodiment shown in FIG. 1, the extruded insulator further includes a radially protruding annular rib 40 located on the nose portion 30 between the external step 36 and the distal end 38 (here, the rib 40 is located adjacent to the opening or mouth of the shell internal bore 26), but such ribs are optional and may be omitted. Skilled artisans will appreciate that rib 40 may be provided to limit or to altogether prevent carbon fouling and other build-up from entering a pocket or space 44 that is located between an outer surface of the insulator 14 and an inner surface of the metallic shell 12. The nose portion 30 may have a continuous and uniform taper along its axial extent, or it could have sections of differing taper or no taper at all (i.e., straight sections where the outer surfaces are parallel to one another). Moreover, the extent to which the nose portion 30 axially extends or protrudes beyond the end of the metallic shell 16 (sometimes referred to as the "projection"), may be greater or less than that shown in FIG. 1. In some cases, it is even possible for the distal end or tip 38 of the nose portion to be retracted within the shell internal bore 26 so that it does not extend beyond the metallic shell at all (i.e., a negative reach).

The intermediate portion 32 of the insulator extends in the axial direction between an external locking feature 50 and the external step 36 described above. In the particular embodiment illustrated in FIG. 1, the majority of the intermediate portion 32 is located and retained within the internal bore 26 of the metallic shell 16. The external locking feature 50 may have a diametrically-enlarged shape so that during a spark plug assembly process an open end or flange 52 of the metallic shell can be folded over or otherwise mechanically deformed in order to securely retain the extruded insulator 14 in place. The folded flange 52 also traps an annular seal or gasket 54 in between an exterior surface of the insulator 14 and an interior surface of the metallic shell 16 so that a certain amount of sealing may be achieved. In some instances, the annular seal or gasket 54 is omitted so that the shell directly contacts the surface of the insulator. Other intermediate portion features are certainly possible as well.

The terminal portion 34 is at the opposite end of the insulator as the nose portion 30 and it extends in the axial direction between a distal end 60 and the external locking feature 50. In the illustrated embodiment, the terminal portion 34 is quite long, however, it may be shorter and/or have any number of other features, like annular ribs. It should be noted that the exemplary embodiment shown in FIG. 1 and described above is only meant to serve as one example of an extruded insulator with a stepped internal bore that is made according to the process taught herein, as that process may be used to make other insulator embodiments, including those that differ significantly from insulator 14. Furthermore, spark plug 10 is not limited to the displayed embodiment and may utilize any combination of other known spark plug components, such as terminal studs, internal resistors, internal seals, various gaskets, precious metal elements, etc., to cite a few of the possibilities.

Figure 2:
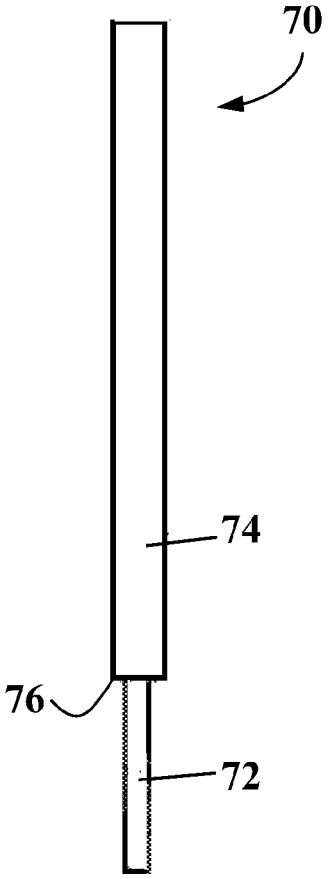
FIG. 2 is a side view of an exemplary arbor that may be used to manufacture an extruded insulator.

With reference to FIG. 2, there is shown an exemplary embodiment of an arbor 70 that may be used during an extrusion process to manufacture an insulator, such as extruded insulator 14. The arbor 70 is a generally elongated and cylindrical tool that is used during extrusion to help form the stepped internal bore 22 of the insulator, as discussed below in more detail. The particular shape, size and configuration of the arbor 70 will largely be dictated by the particulars of the insulator internal bore being formed (e.g., the number of internal step portions 24 in the internal bore 22 will dictate the number of external step portions 76 in the arbor). In the embodiment of FIG. 2, the arbor 70 includes a first portion 72 having a smaller diameter and a second portion 74 having a larger diameter. The first portion 72 is generally designed to form that segment of the insulator internal bore 22 that corresponds to the nose portion 30, while the second portion 74 is intended to form that segment of the insulator internal bore that corresponds to intermediate and terminal portions 32, 34. The external step portion 76 transitions between first and second portions 72, 74 of the arbor and corresponds to the internal step portion 24 in the insulator internal bore 22. Because the extruded insulator 14 is preferable made from a ceramic paste that is injected in and forms around the arbor 70 during the extrusion process, as subsequently explained, it may be preferable for the arbor to be coated with certain low friction materials, such as diamond or diamond-like coatings or those having titanium nitride. It is also possible to periodically lubricate the arbor with oil. These and other features of the arbor 70 will be apparent to skilled artisans are intended to be within the scope of the present disclosure.

Figure 3:
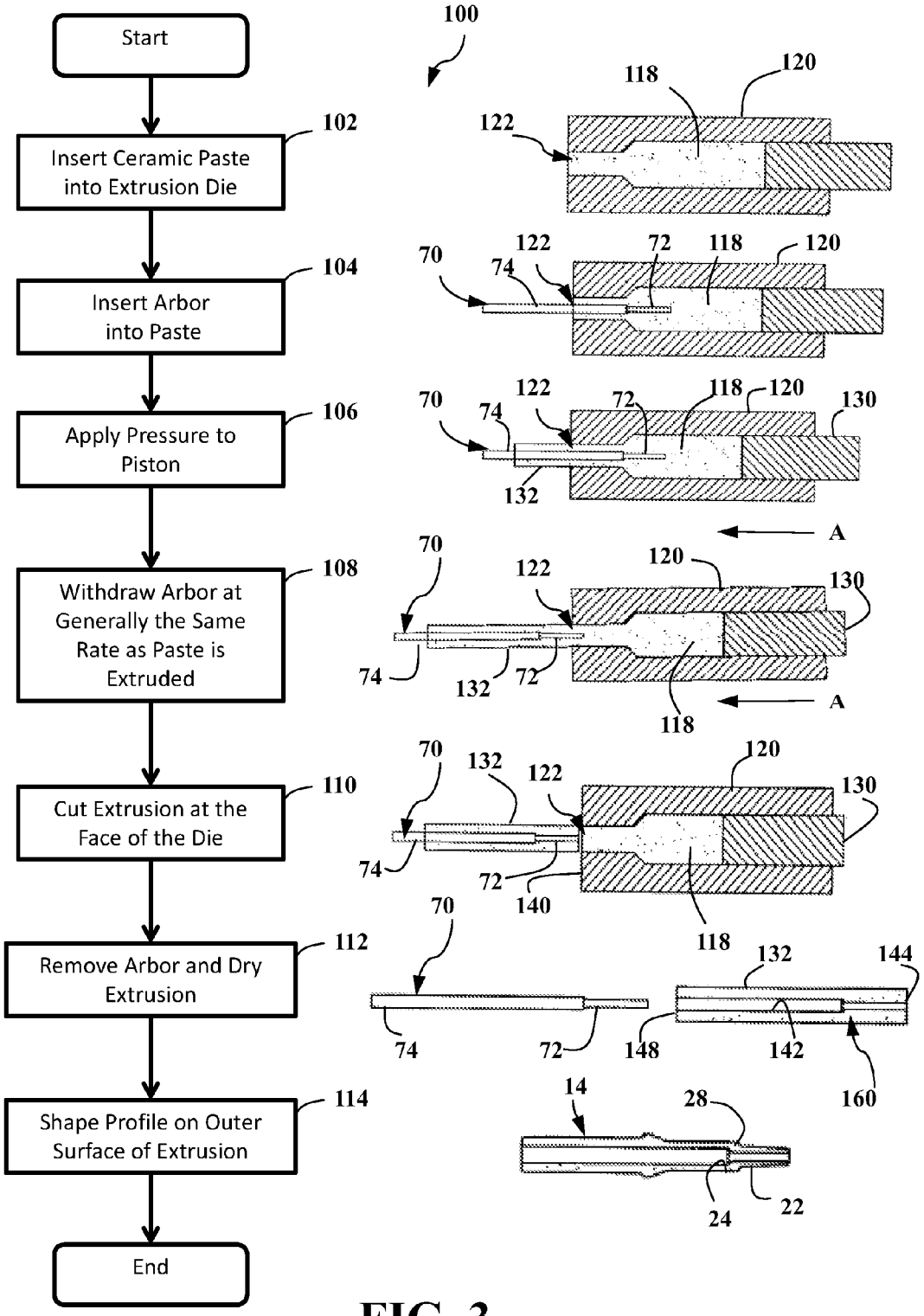
FIG. 3 is a flowchart with corresponding images that illustrate the different steps or stages of an exemplary method for manufacturing an extruded insulator.

Turning now to FIG. 3, there is shown a flowchart with accompanying drawings that illustrates an exemplary process 100 for making an extruded insulator with a stepped internal bore, such as insulator 14. Beginning with step 102, the method inserts or injects a ceramic paste 118 into an extrusion die 120. A variety of different ceramic pastes or other materials may be used to form extruded insulator 14, including a ceramic paste that includes ceramic particles, a liquid medium, and a binder (e.g., about 50% ceramic particles, 48% liquid medium such as water, and 2% binder such as methylcellulose (by volume)). According to an exemplary embodiment, the ceramic particles are provided in the form of alumina, talc, and/or clay powder, the liquid medium is water, and the binder is comprised of a cellulose polymer. A non-limiting example of a suitable ceramic particle composition (by weight) is a ceramic powder mixture that includes about 87.7-92.6 wt % alumina, 3.5-7.3 wt % kaolin and/or bentonite, 0-1.6 wt % talc, 2.8-4.9 wt % calcium carbonate and 0-0.3 wt % zirconia, and has a typical particle size of about 2.5-3.5 μm. Another suitable ceramic particle composition includes about 98.19 wt % alumina, 0.84 wt % kaolin and/or bentonite, 0.22 wt % talc, 0.68 wt % calcium carbonate and 0.08 wt % zirconia, and has an average particle size of about 1.2-1.8 μm. Of course, other ceramic paste and ceramic particle compositions could be used instead, including any of the examples set forth in U.S. Pat. No. 7,169,723, the contents of which are hereby incorporated by reference. The ceramic paste may have a consistency similar to clay and, as understood by those skilled in the art, may have a sufficient yield stress to prevent deformation under its own weight. Once the ceramic paste has been properly mixed or otherwise prepared, it is inserted into, injected into and/or provided to extrusion die 120 through one or more openings in the die. Any known technique for supplying an extrusion die with such material may be utilized.

Next, in step 104, the arbor 70 is inserted into and is properly aligned within the extrusion die 120. According to one possible technique, the diametrically reduced first portion 72 of the arbor 70 is inserted into opening 122, and the arbor is pushed partway into the extrusion die so that a portion of the arbor is surrounded by the ceramic paste. Any type of suitable alignment or positioning tools may be used to ensure that the arbor 70 is properly aligned (e.g., co-aligned with a central axis of extrusion die 120) and is inserted a pre-determined distance into the extrusion die. Once the ceramic paste 118 and the arbor 70 are in place, the extrusion process may begin.

In step 106, which corresponds to a first extrusion phase, pressure or force is exerted by a piston 130 so that the ceramic paste 118 is forced through the extrusion die 120 and surrounds a portion of the arbor 70. As the piston 130 advances in the direction of arrow A, the ceramic paste 118 becomes compressed within the narrowing portion of the extrusion die 120 and squeezes or extrudes out of the open end 122; this occurs while the arbor 70 is maintained in place or is kept stationary. As illustrated in the drawing accompanying step 106, an extruded section of ceramic material 132 forms around the arbor 70 and generally assumes the shape of the opening 122. Pressure or force by the piston 130 in direction A continues until the piston, the extruded section 132, or some other component reaches a certain predetermined position, at which point the method progresses to step 108.

In step 108, which corresponds to a second extrusion phase, the arbor 70 is allowed to be withdrawn at the same rate as the extruded section 132. Put differently, further pressure or force by piston 130 causes additional ceramic paste to be extruded from open end 122; however, instead of maintaining the arbor 70 stationary, the arbor is allowed to retract or move out of the extrusion die 120 at the same rate as the surrounding extruded ceramic paste. This way, the arbor 70 and the extruded section 132 are pushed or extruded at the same rate so that there is generally no relative movement therebetween. This is evidenced in the drawing that corresponds to step 108, where both the arbor 70 and the extruded section 132 have larger segments that are retracted or withdrawn from the extrusion die 122 than in the previous step 106. Skilled artisans will appreciate that due to the diametrically reduced section of the extrusion die interior near open end 122, linear movement in direction A by the piston 130 will likely result in a greater amount of linear movement by arbor 70 and extruded section 132. It is preferable that proper arbor orientation or alignment be maintained during step 108 so that the arbor does not become misaligned or tilted within the extruded section 132.

Once extruded, step 110 cuts, severs or otherwise separates the extruded section 132, with the arbor 70 located therein, from the rest of the ceramic paste 118 still in the extrusion die 122. This severing process may occur at the face 140 of the extrusion die 120 where the open end 122 is located, or it may occur at a location inboard or outboard of that face. As will be appreciated by one having ordinary skill in the art, it is preferable that the extruded section 132 be severed or otherwise separated at a location that precisely corresponds to the end of first portion 72 of the arbor 70 so that, once the arbor is removed, the stepped internal bore 142 formed in the extruded section 132 will be open at a distal end 144. Similarly, by having the end of the arbor second portion 74 extending out of the other end of the extruded section 132, it ensures that the stepped internal bore 142 is open at the other distal end 148 as well. It is not necessary, however, for extruded section 132 to be open at both ends of internal bore 142, as these ends could be subsequently drilled or otherwise formed, but it may be useful in eliminating a manufacturing step. Cutting the extruded portion does not always result in clean square ends. Therefore, the process may include a squaring or truing step for addressing the ends, particularly the terminal end 148, prior to shaping the profile; this optional step or process may be part of steps 110, 112 and/or 114.

At this point, the arbor 70 may be removed from the extruded section 132 so that an extruded insulator blank 160 can be dried and formed with an internal bore 142 extending between the two distal ends 144, 148, step 112. The removal of the arbor 70 may occur before, during or after drying or heat treatments, and may be done slowly, rapidly or according to some other technique. In a preferred embodiment, the arbor 70 is removed before drying or during the early stages of drying as some shrinkage with the extruded insulator blank 160 can occur during drying. If the arbor 70 is removed immediately after the extrusion process and before drying, a single arbor may be mounted on the extrusion machine and used repeatedly as insulators are formed in the manufacturing process. According to another embodiment, multiple arbors 70 may be used so that each of the insulators can dry for some period of time before arbor removal. Other embodiments are certainly possible. Any known drying and/or heating techniques, such as sintering, may be used to form or otherwise transform the extruded ceramic paste into a dense and solidified ceramic material, and such techniques may be applied at any suitable step or stage of method 100. As mentioned above, coating the arbor 70 with a low friction material may facilitate easier withdraw or removal of the arbor from the extruded ceramic material.

In step 114, the outer profile of the extruded insulator blank 160 may be shaped, worked and/or otherwise formed so that it assumes the desired shape of the final insulator component, like that of extruded insulator 14 shown in FIG. 1. Insulator features such as the nose portion 30, the intermediate portion 32, the terminal portion 34, the distal end 38, the external step 36, the annular rib 40, the external locking feature 50, as well as many others, may be formed during this step using commonly known techniques like turning, grinding, cutting, sanding, polishing, buffing, etc. In one potential embodiment, the extruded insulator blank 160 is formed with the use of a profiled grinding wheel, but any combination of insulator shaping techniques, including those mentioned above and commonly used to form dry-pressed insulators, may be employed. Other suitable insulator or ceramic processing techniques may be incorporated as well.

One potential difference between the microstructures of dry pressed insulators and extruded insulators formed according to process 100 is that the types of defects (e.g., relics and different kinds of voids) commonly associated with dry pressing will be reduced or largely be absent from the extruded insulators. For example, triangular voids can form when packing voids between large spray dried granular particles are not eliminated during dry pressing, and there can be persistent granule interfaces and pores from hollow granules. Another potential difference in the microstructures of dry pressed insulators versus extruded insulators is that there may be greater alignment of grains parallel to an extrusion axis with extruded insulators because the particles within the extrusion paste tend to align during the flow of the ceramic paste during extrusion. Other microstructure differences and distinctions may also exist.

It is to be understood that the foregoing is a description of one or more preferred exemplary embodiments. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A method of making an extruded insulator for a spark plug, comprising the steps in the order of:

mixing together ceramic particles, a liquid medium, and a binder to form a ceramic paste;

inserting the ceramic paste into an extrusion die;

inserting an arbor into the ceramic paste in the extrusion die;

extruding the ceramic paste around the arbor so as to form an extruded section;

severing the extruded section from the rest of the ceramic paste in the extrusion die so as to form a severed extruded section, wherein the severed extruded section includes the arbor; and removing the arbor from the severed extruded section so as to form an extruded insulator blank having a stepped internal bore to form the extruded insulator for the spark plug.

2. The method of claim 1, wherein the ceramic particles include a ceramic particle mixture having 87.7-98.19 wt% alumina; 0.84-7.3 wt% kaolin, bentonite, or a combination of kaolin and bentonite; 0.68-4.9 wt% calcium carbonate; optionally up to 1.6 wt% talc; and optionally up to 0.3 wt% zirconia.

3. The method of claim 1, wherein the ceramic particles have an average particle size of 1.2-3.5 μm.

4. The method of claim 1, wherein the arbor is an elongated cylindrical tool and includes a first portion, a second portion that has a larger diameter than the first portion, and an external step portion that separates the first and second portions.

5. The method of claim 4, wherein the step of inserting an arbor further comprises inserting the arbor into the ceramic paste through an opening in the extrusion die so that the first portion of the arbor is entirely surrounded by the ceramic paste and the second portion of the arbor is at least partially surrounded by the ceramic paste.

6. The method of claim 4, wherein the step of extruding the ceramic paste further comprises a first extruding phase where the ceramic paste is extruded out of an opening in the extrusion die while maintaining the arbor stationary with respect to the extrusion die.

7. The method of claim 6, wherein at the conclusion of the first extruding phase, the extruded section is formed around the second portion of the arbor and only the second portion of the arbor is located outside of the extrusion die.

8. The method of claim 6, wherein the step of extruding the ceramic paste further comprises a second extruding phase where the ceramic paste is extruded out of the opening in the extrusion die while allowing the arbor to move with respect to the extrusion die.

9. The method of claim 8, wherein at the conclusion of the second extruding phase, the extruded section is formed around the first and second portions of the arbor and both the first and second portions of the arbor are located outside of the extrusion die.

10. The method of claim 1, wherein the step of severing the extruded section further comprises severing the extruded section from the rest of the ceramic paste in the extrusion die at a location that corresponds to an end of the first portion of the arbor so that the stepped internal bore will be open at a distal end.

11. The method of claim 1, wherein the step of removing the arbor further comprises removing the arbor from the extruded section before the extruded section is fired into a hard ceramic material.

12. The method of claim 1, further comprising the step of:

shaping the outer profile of the extruded insulator blank so as to form a spark plug insulator having a nose portion, an intermediate portion, and a terminal portion, wherein the stepped internal bore is largely unchanged.

13. The method of claim 1, wherein the stepped internal bore extends the entire axial length of the extruded insulator and includes one or more internal step portions configured to receive and seat a spark plug center electrode with one or more external step portions.

* * * * *